United States Patent [19]

Mort et al.

[11] Patent Number: 4,544,617

[45] Date of Patent: Oct. 1, 1985

[54] ELECTROPHOTOGRAPHIC DEVICES CONTAINING OVERCOATED AMORPHOUS SILICON COMPOSITIONS

[75] Inventors: Joseph Mort, Webster; Frank Jansen, Walworth; Steven J. Grammatica, East Rochester; Michael A. Morgan, Penfield, all of N.Y.

[73] Assignee: Xerox Corporation, Stamford, Conn.

[21] Appl. No.: 548,117

[22] Filed: Nov. 2, 1983

[51] Int. Cl.[4] ..... G03G 5/082; G03G 5/09; G03G 5/14

[52] U.S. Cl. ..... 430/58; 430/57; 430/66; 430/67; 252/501.1; 427/74; 357/2

[58] Field of Search ..... 430/57, 65, 66, 67, 430/58; 427/74; 252/501.1; 357/2

[56] References Cited

U.S. PATENT DOCUMENTS

| | | | |
|---|---|---|---|
| 3,422,321 | 1/1969 | Tombs | 317/235 |
| 3,716,844 | 2/1973 | Brodsky | 340/173 LS |
| 4,254,161 | 3/1981 | Kemlage | 427/94 |
| 4,265,991 | 5/1981 | Hirai et al. | 430/64 |
| 4,271,582 | 6/1981 | Shirai et al. | 29/571 |
| 4,273,805 | 6/1981 | Dawson et al. | 427/88 |
| 4,297,392 | 10/1981 | Higashi et al. | 427/75 |
| 4,330,182 | 5/1982 | Coleman | 352/2 |
| 4,333,964 | 6/1982 | Ghezzo | 427/93 |
| 4,359,512 | 11/1982 | Fukuda et al. | 430/65 X |
| 4,359,514 | 11/1982 | Shimizu et al. | 430/65 |
| 4,361,638 | 11/1982 | Higashi et al. | 430/58 |
| 4,365,013 | 12/1982 | Ishioka et al. | 430/57 |
| 4,377,628 | 3/1983 | Ishioka et al. | 430/57 |
| 4,378,417 | 3/1983 | Maruyama et al. | 430/57 |
| 4,394,425 | 7/1983 | Shimizu et al. | 430/65 |
| 4,394,426 | 7/1983 | Shimizu et al. | 430/65 |
| 4,418,132 | 11/1983 | Yamazaki et al. | 430/57 |
| 4,443,529 | 4/1984 | Kanbe et al. | 430/65 |
| 4,452,874 | 6/1984 | Ogawa et al. | 430/57 |
| 4,452,875 | 6/1984 | Ogawa et al. | 430/57 |

FOREIGN PATENT DOCUMENTS

| | | | |
|---|---|---|---|
| 56-25743 | 3/1981 | Japan | 430/57 |

*Primary Examiner*—Roland E. Martin
*Attorney, Agent, or Firm*—E. O. Palazzo

[57] ABSTRACT

Disclosed is an electrophotographic photoresponsive device comprised of a supporting substrate, an amorphous silicon charge transport layer, a trapping layer comprised of doped amorphous silicon, and a top insulating overcoating layer.

23 Claims, 3 Drawing Figures

ELECTROPHOTOGRAPHIC DEVICES CONTAINING OVERCOATED AMORPHOUS SILICON COMPOSITIONS

BACKGROUND OF THE INVENTION

This invention is generally directed to the use of amorphous silicon compositions as electrophotographic imaging members, and more specifically, the present invention is directed to photoresponsive layered imaging devices comprised of amorphous silicon overcoated with insulating protective layers. In one embodiment of the present invention, there are provided overcoated layered photoresponsive devices containing two amorphous silicon layers. These devices can be incorporated into an electrophotographic imaging system, particularly xerographic imaging systems, wherein the latent electrostatic images which are formed, can be developed into images of high quality, and excellent resolution.

Electrostatographic imaging systems, particularly xerographic imaging systems are well known, and are extensively described in the prior art. In these systems generally, a photoresponsive or photoconductor material is selected for forming the latent electrostatic image thereon. This photoreceptor is generally comprised of a conductive substrate containing on its surface a layer of photoconductive material, and in many instances, a thin barrier layer is situated between the substrate and the photoconductive layer to prevent charge injection from the substrate, which injection would adversely affect the quality of the resulting image. Examples of known useful photoconductive materials include amorphous selenium, alloys of selenium, such as selenium-tellurium, selenium-arsenic, and the like. Additionally, there can be selected as the photoresponsive imaging member various organic photoconductive materials, including, for example, complexes of trinitrofluorenone and polyvinylcarbazole. Recently, there has been disclosed multilayered organic photoresponsive devices containing a charge transport layer comprised of for example substituted diamines dispersed in an inactive resinous binder, and a photogenerating layer, reference U.S. Pat. No. 4,265,990 the disclosure of which is totally incorporated herein by reference. Examples of charge transport layers include various diamines, while examples of photogenerating layers include trigonal selenium, metal and metal-free phthalocyanines, vanadyl phthalocyanines, squaraine compositions, and the like.

Many other patents are in existence describing photoresponsive devices containing generating substances, such as U.S. Pat. No. 3,041,167, which discloses an overcoated imaging member containing a conductive substrate, a photoconductive layer, and an overcoating layer of an electrically insulating polymeric material. This member is functional in an electrophotographic method by, for example, initially charging the photoresponsive device with an electrostatic charge of a first polarity, imagewise exposing enabling the formation of an electrostatic latent image thereon, and subsequently developing the resulting image. Prior to each succeeding imaging cycle, the photoconductive member can be charged with an electrostatic charge of a second opposite polarity, and sufficient additional charges of this polarity are applied so as to create across the member a net electrical field. Simultaneously, mobile charges of the first polarity are created in the photoconductive layer by applying an electrical potential to the conductive substrate. The imaging potential which is developed to form the visible image is present across the photoconductive layer and the overcoating layer.

There is also disclosed in a copending application, U.S. Ser. No. 524,801, electrostatographic imaging devices containing compensated amorphous silicon compositions, wherein there is simultaneously present in the amorphous silicon dopant materials of boron and phosphorous. More specifically there is disclosed in the copending application a photoresponsive device comprised of a supporting substrate, and an amorphous silicon composition containing from about 25 parts per million by weight to about 1 weight percent of boron, compensated with from about 25 parts per million by weight to about 1 weight percent of phosphorous.

Additionally amorphous silicon photoconductors are known, thus for example there is disclosed in U.S. Pat. No. 4,265,991 an electrophotographic photosensitive member containing a substrate, a barrier layer, and a photoconductive overlayer of amorphous silicon containing 10 to 40 atomic percent of hydrogen and having a thickness of 5 to 80 microns. Further described in this patent are several processes for preparing amorphous silicon. In one process embodiment, there is prepared an electrophotographic sensitive member by heating the member in a chamber to a temperature of 50° C. to 350° C., introducing a gas containing a hydrogen atom into the chamber, causing an electrical discharge by electric energy to ionize the gas, in the space of the chamber in which a silicon compound is present, followed by depositing amorphous silicon on an electrophotographic substrate at a rate of 0.5 to 100 Angstroms per second, thereby resulting in an amorphous silicon photoconductive layer of a predetermined thickness. While the amorphous silicon device described in this patent is photosensitive, after a minimum number of imaging cycles, less than about 10, for example, unacceptable low quality images of poor resolution, with many deletions, result. With further cycling, that is, subsequent to 10 imaging cycles and after 100 imaging cycles, the image quality continues to deteriorate often until images are partially deleted. Accordingly, while the amorphous silicon photoresponsive device of the '991 patent is useful, its selection as a commercial device which can be used functional for a number of imaging cycles is not readily achievable.

While it is not desired to be limited to theory, it is believed that the degradation of the electrophotographic performance of amorphous silicon is caused by the sensitivity of the surface of the silicon device to physical and chemical alterations, including abrasion, scratching, and exposure to a corona atomsphere, especially at high humidities. These sensitivities create fundamental limitations for the practical use of devices wherein the exposed surface contains substantially amorphous silicon. This problem can be minimized by encapsulating the amorphous silicon with a chemically passive, hard overcoating layer of amorphous silicon nitride, amorphous silicon carbide, or amorphous carbon, however when these devices are incorporated into xerographic imaging systems there results image blurring and very rapid image deletion in a few imaging cycles, typically less than about 10. With overcoated silicon devices, poor image quality with cycling is caused by an increase in the surface conductivity of the underlying amorphous silicon layer, rather than by abrasion or chemical interactions with the photosensitive surface as occurs with amorphous silicon containing no protective overcoating layer, which conductivity increase is induced by the electric field existing at the surface of the overcoated device, similar to that resulting from the field effect in well-known metal-insulator-semiconductor devices. The induced surface conductivity causes a lateral spreading of the photogenerated charges in the electric field fringe fields associated with line or edge images projected on the photoreceptor surface, thus causing undesirable image blurring and image deletion.

The existence of a field effect phenomena in amorphous silicon is well known, as this material functions as an extrinsic amorphous semiconductor, that is, a semiconductor whose conductivity can be substantially modified by impurity doping and by electric fields. In contrast, the conductivities of many other photoreceptor materials, such as those based on chalcogenides, will not be significantly modified by either impurity doping or electric fields.

The above disadvantages are substantially eliminated with the photoresponsive device of the present invention, accordingly for example image deletion, and image blurring, is not observed in the photoconductive devices of the present invention comprised of overcoated amorphous silicon compositions with a thin trapping layer situated between the amorphous silicon composition and the insulating overcoating layer. Essentially this device is a multilayered structure of such design as to minimize or eliminate the induced lateral conductivity and the image blurring and deletion caused thereby. More specifically, the present invention provides substantially hydrogenated amorphous silicon compositions and device structures incorporating trapping layers, which function to prevent image resolution loss. By trapping, which term is well known in the semiconductor arts, is meant the immobilization of a charge carrier. This spatial immobilization is provided by a trapping site, the existence of which is caused and controlled by extrinsic means such as the disruption of native atomic bonds or the incorporation of dopants therein. Image deletion, and image blurring, is not observed in the photoconductive devices of the present invention comprised of overcoated amorphous silicon compositions with a thin trapping layer situated between the amorphous silicon composition and the insulating overcoating layer.

Thus, while amorphous silicon based devices with and without, the trapping layers of the present invention are substantially electrically similar, that is, they are both photosensitive, can be charged to high electric fields, and have good carrier range, they differ significantly in their image capabilities in that after 10 imaging cycles, images formed with amorphous silicon photoconductors which are overcoated to passify the surface, but which do not incorporate a trapping layer begin to deteriorate rapidly as disclosed hereinbefore. There thus continues to be a need for improved photoconductor materials, particularly photoconductive devices containing amorphous silicon which can be repeatedly used in a number of imaging cycles without deterioration therefrom. Additionally, there continues to be a need for improved layered imaging members containing amorphous silicon insulating overcoated multilayered structures which are designed to be humidity insensitive, and are not adversely affected by the electrical consequences resulting from scratching and abrasion. Further there continues to be a need for improved photoresponsive devices containing charge carrier trapping layers, which devices can be prepared with a minimum number of processing steps, and wherein the layers are sufficiently adhered to one another to allow the continuous use of such devices in repetitive imaging and printing systems. Moreover, there continues to be a need for photoresponsive devices containing charge carrier trapping layers, wherein the incorporation of these layers in such devices do not adversely affect the electrical and photoconductive characteristics thereof; and wherein the xerographic imaging capabilities of the devices are significantly improved. Also, there continues to be a need for amorphous silicon materials which can be selected for incorporation into an electrophotographic imaging system, wherein such materials are not sensitive to humidity and corona ions generated by the charging apparatus, thereby allowing such a material to be useful over a substantial number of imaging cycles without causing a degradation in image quality, and specifically, without resulting in blurring of the images produced. There further continues to be a need for amorphous multilayered silicon-based devices which do not incorporate high dopant concentrations thereby causing undesirable cross contamination effects during sequential layer deposition. Finally, there continues to be a need for amorphous silicon multilayered devices where the electrical performance thereof is critically depend on the details of the fabrication process which is used to form the interfaces between the various layers.

SUMMARY OF THE INVENTION

It is therefore an object of the present invention to provide photoresponsive imaging devices which overcome the above-noted disadvantages.

A further specific object of the present invention resides in the provision of improved layered photoresponsive devices containing amorphous silicon compositions which are designed to trap charge carriers of one polarity while conducting charge carriers of another second opposite polarity.

In a further object of the present invention there are provided photoconductive devices containing amorphous silicon compositions which immobilize charge carriers, which devices are substantially insensitive to humidity, and to ions generated for a corona charging apparatus, thereby enabling the use of these devices in xerographic imaging systems for obtaining images of high quality and excellent resolution with no blurring for a number of imaging cycles.

In yet another object of the present invention, there are provided photoresponsive imaging devices containing amorphous silicon compositions, with various amounts of phosphorous and boron, or similar dopants, such as arsenic or nitrogen.

These and other objects of the present invention are accomplished by the provision of multilayered amorphous silicon photoreceptor devices. More specifically, in accordance with the present invention, there are provided layered photoresponsive devices comprised of amorphous silicon as a charge carrier transport layer, situated between a supporting substrate, and a thin trapping layer of heavily doped amorphous silicon and overcoating layers of, for example, silicon nitride, silicon carbide, amorphous carbon, and the like on top of the trapping layer.

In a specific embodiment, the present invention is directed to a photoresponsive device comprised in the order stated of (1) a supporting substrate, (2) a carrier transport layer comprised of uncompensated or undoped amorphous silicon, or amorphous silicon slightly doped with p or n type dopants such as boron or phosphorous, (3) a trapping layer comprised of amorphous silicon which is heavily doped with p or n type dopants such as boron or phosphorous, and (4) a top overcoating layer of silicon nitride, silicon carbide, or amorphous carbon, wherein the top overcoating layer can be optionally rendered partially conductive as illustrated hereinafter.

The photoresponsive devices of the present invention can be incorporated into various imaging systems, particularly xerographic imaging systems. In these systems, latent electrostatic images are formed on the devices involved, followed by developing the images with known developer compositions, subsequently transferring the image to a suitable substrate, and optionally permanently affixing the image thereto. The photoresponsive imaging members of the present invention when incorporated into these systems are insensitive to humidity conditions and corona ions generated from corona charging devices, enabling these members to generate acceptable images of high resolution for an extended number of imaging cycles exceeding, in most instances, 100,000 imaging cycles, and approaching over one million imaging cycles. Moreover, the photoconductive imaging members of the present invention can be selected for use in xerographic printing systems.

BRIEF DESCRIPTION OF THE DRAWINGS

For a better understanding of the present invention and further features thereof, reference is made to the following detailed description of the preferred embodiments wherein.

DESCRIPTION OF THE PREFERRED EMBODIMENTS

Figure 1:
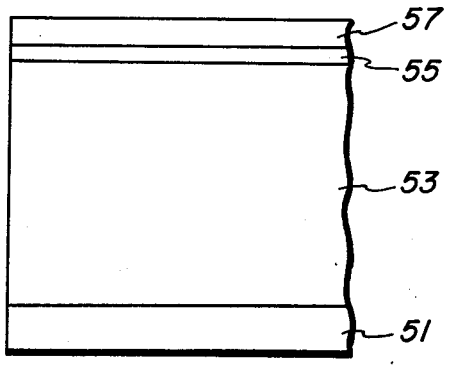
FIG. 1 is a partially schematic cross-sectional view of the photoresponsive device of the present invention.

Illustrated in FIG. 1 is a photoresponsive device of the present invention, comprised of a supporting substrate 51, a carrier generation and transport layer 53 of undoped amorphous silicon, or amorphous silicon doped with from about 4 parts per million to about 25 parts per million of boron or phosphorous, a trapping layer 55 doped with more than about 50 parts per million of boron or phosphorous, and a top overcoating layer 57, comprised of silicon nitride, silicon carbide, or amorphous carbon.

Figure 2:
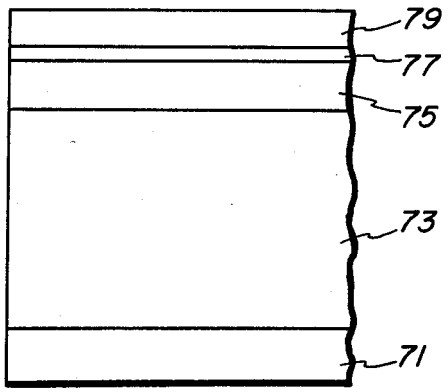
FIG. 2 is a partially schematic cross-sectional view of a further photoresponsive device of the present invention.

Illustrated in FIG. 2 is a photoresponsive device of the present invention comprised of a supporting substrate 71, a carrier transport layer 73, of amorphous silicon doped with about 4 to about 25 parts per million of boron or phosphorous, a carrier generation layer 75 of amorphous silicon alloyed with germanium or tin, a carrier trapping layer 77 of amorphous silicon doped with more than about 50 parts per million of boron or phosphorous and a protective top overcoating layer 79.

Figure 3:
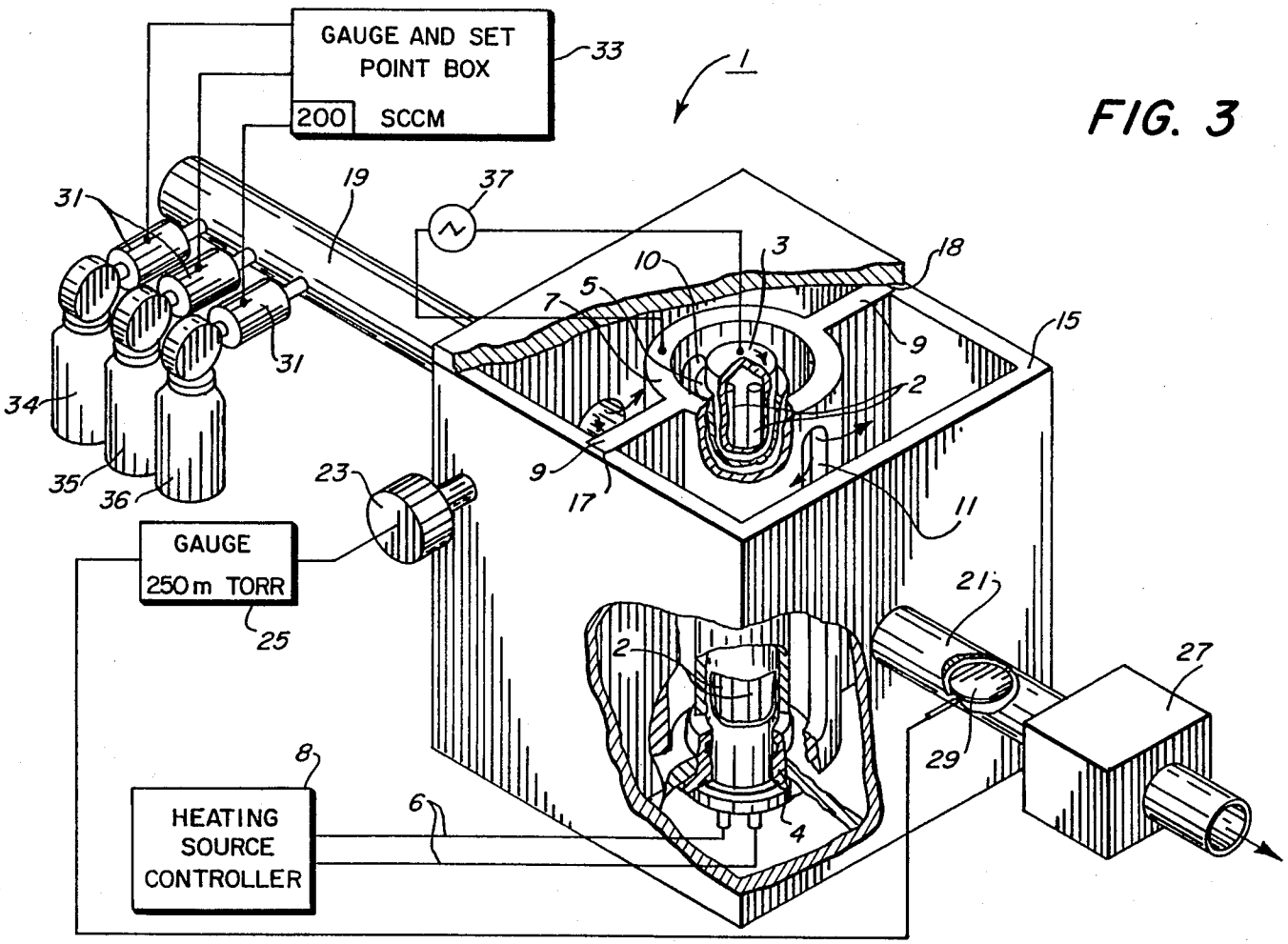
FIG. 3 illustrates an apparatus for preparing amorphous silicon compositions, and devices containing such compositions.

Illustrated in FIG. 3 is an apparatus which can be used for fabrication of the described devices and compositions. There is thus illustrated in this Figure a cylindrical electrode 3 which is secured to an electrically insulated rotating shaft, containing heating elements 2 with connecting wires 6, connected to heating source controller 8. A cylindrical substrate 5 is secured by end flanges to the cylindrical electrode 3. Furthermore there is illustrated a cylindrical counter electrode 7 which is coaxial with cylindrical electrode 3 and which contains flanges 9 thereon and slits 10 and 11 therein, vacuum chamber 15, containing as an integral part receptacles 17 and 18 for flanges 9, vacuum sensor 23, a gauge 25, and a vacuum pump 27 with a throttle value 29. Gas pressure vessels 34, 35, 36 are connected through flow controls 31 to manifold 19 and the vacuum chamber 15. The gas flow controls 31 are electrically controlled and read out from gauge and set point box 33. Also, an electrical source is connected to the cylindrical electrode 3 and the counter electrode 7.

Although not specifically illustrated in the Figures, there is also included within the scope of the present invention, photoresponsive devices substantially equivalent to the devices as illustrated in FIG. 1, with the exception that the top overcoating layer is rendered partially conductive. Thus, the overcoating layer of FIG. 1, comprised of silicon nitride, or silicon carbide, is rendered conductive by fabricating these layers in such a way that a non-stoichiometric composition $SiN_x$, or $SiC_y$ results, wherein x is a number of from about 1 to about 1.3, and y is a number of from 0.7 to about 1.3. These compositions render the top overcoating layer more electrically conductive than highly insulating stoichiometric compositions. Moreover, there is included in the present invention photoresponsive devices, substantially equivalent to the device as illustrated in FIG. 1, wherein the top overcoating layer 57 is comprised of silicon nitride, silicon carbide, or amorphous carbon, doped with from about 0.5 percent to about 5 percent of phosphorous or boron, which doping renders the insulating overcoatings partially conductive enabling the further enhancement of image quality.

The supporting substrate for each of the photoresponsive devices illustrated in the figures may be opaque or substantially transparent, and may comprise various suitable materials having the requisite mechanical properties. Thus this substrate can be comprised of numerous substances providing the objectives of the present invention are achieved. Specific examples of substrates include insulating materials such as inorganic or organic polymeric materials, a layer of an organic or inorganic material having a semiconductive surface layer thereon, such as indium tin oxide, or a conductive material such as, for example, aluminum, chromium, nickel, brass, stainless steel, or the like. The substrate may be flexible or rigid and may have many different configurations, such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material, an anticurl layer, such as, for example, polycarbonate materials, commercially available as Markrolon. The substrates are preferably comprised of aluminum, stainless steel sleeve, or an oxidized nickel composition.

The thickness of the substrate layer depends on many factors including economical considerations, and required mechanical properties. Accordingly, thus this layer can be of a thickness of from about 0.01 inches to about 0.2 inches, and preferably is of a thickness of from about 0.5 inches to about 0.15 inches. In one particularly preferred embodiment, the supporting substrate is comprised of oxidized nickel, in a thickness of from about 1 mil to about 10 mils.

The charge carrier amorphous silicon layers, reference layers 53 and 73, are of a thickness of from about 5 to about 40 microns, and preferably are of a thickness of from about 10 to about 20 microns. This layer is generally doped with up to 10 parts per million of boron, or phosphorous. However, this layer can also be undoped or contain higher levels of dopant non-uniformily mixed therein with the high level dopant located near the bottom interface of this layer. Additionally, other substances can be used as dopants for the amorphous silicon layer such as arsenic, nitrogen, and the like. Other compositions may also be added to the amorphous silicon as alloying materials, including carbon and germanium.

A very important layer for the photoresponsive devices illustrated, are the heavily doped amorphous silicon trapping layers. Trapping, in accordance with the present invention, refers to the spatial immobilization of charge carriers by for instance n-type or p-type dopants, such as phosphorous, or boron, contained in amorphous silicon compositions. It is these dopants which provide for the needed trapping sites. Thus the presence of phosphorous or boron dopants in amorphous silicon substances, causes positive or negative charge carriers to be captured or trapped, wherein the trapping probability is about proportional to the number of trapping sites. The amorphous silicon trapping layers of the present invention are prepared, for example, by introducing into a reaction chamber, as more specifically detailed hereinafter, a silane gas, doped with diborane gas or phosphine gas. A useful range of doping for the trapping layer of the present invention is from about 25 parts per million of dopant, to 1 percent, or 10,000 parts per million of dopant, wherein parts per million refers to the weight concentration of the individual dopant atoms, such as boron, or phosphorous, in the amorphous silicon material. The use of relatively thin trapping layers allows charging of the resulting photoresponsive devices at high fields, for example up to 50 volts per micron, while simultaneously deriving the beneficial effects of these layers as anti-blurring layers. Additionally, the devices of the present invention, are desirably humidity insensitive, and remain unaffected by humidity and corona ions generated by corona charging devices. These properties provide photoresponsive devices which can be desirably used for numerous imaging cycles, allowing for the production of high quality non-blurred images for a substantial number of imaging cycles. The amorphous silicon-based multilayer structures described, thus provide devices which can be selected for use in a photoconductive imaging apparatuses. These devices not only possesses desirable electrical properties and desirable photosensitivity, but also enable a substantial number of imaging cycles without deterioration of the image, in contrast to known amorphous silicon materials which deteriorate undesirably in less than 10 imaging cycles.

It is known that by adding boron alone to amorphous silicon, about 4 to 25 parts per million, the hole transport properties thereof improve, however, the charge acceptance decreases slightly. However, electrons do not migrate through such a doped device and the device cannot be photodischarged negatively. A complimentary situation occurs when incorporating phosphorous alone into amorphous silicon. In contrast, the hole transport properties of the device are significantly decreased, and electron transport properties increased, thus this device cannot be positively light discharged. Likewise, the addition of 100 parts per million of boron alone to amorphous silicon renders the resulting device very conductive, allowing it to be charged to only a very low potential, below about 1 volt/$\mu$m, when such a high dopant concentration is present in a single layer device. Multilayered photoresponsive devices or photoreceptors comprised of the amorphous silicon materials in the structural configuration of the present invention can contain boron or for example phosphorous in the trapping layer even at levels well in excess of 100 parts per million, and these devices can be charged to high fields of for example of about 50 volts per micron; and also such devices possess desirable carrier transport properties when the trapping layer is sufficiently thin.

While the electrical properties of the multilayered amorphous silicon device are substantially similar to the electrical properties of an overcoated amorphous silicon device without a trapping layer, these two structures differ significantly in their image capabilities in that with photoresponsive devices containing a heavily doped trapping layer between the amorphous silicon and the insulative overcoat, degradation of the devices does not result, since the devices involved are not sensitive to humidity and corona ions generated by corona charging apparatuses. The imaging capabilities of compensated amorphous silicon, reference copending application U.S. Ser. No. 524,801 filed Aug. 17, 1983, on Electrostatographic Devices Containing Compensated Amorphous Silicon Compositions, the disclosure of which is totally incorporated herein by reference, with respect to corotron interaction is also desirably improved for overcoated devices containing a trapping layer in view of what is believed to be the elimination of the formation of a laterally conductive surface area. Further, the use of an insulating and hard overcoating in combination with a trapping layer, allows the devices of the present invention to be useful for a substantial number of increased imaging cycles, as compared to devices containing a single layer of amorphous silicon or a single layer with an overcoat; and furthermore, with the present device structure, image quality is excellent, and image blurring is eliminated, which blurring is present with overcoated or unovercoated amorphous silicon without a trapping layer, beginning with less than about 10 imaging cycles.

With reference to FIG. 1, the heavily doped amorphous silicon trapping layer 55 has a doping level of from in excess of about 50 parts per million to about 1 percent by weight, and preferably is of a compensation level of 100 parts per million. Generally, the thickness of the doped amorphous silicon trapping layer is from about 50 Angstroms to about 5,000 Angstroms, and preferably is of a thickness of from about 100 Angstroms to about 1,000 Angstroms.

As doping materials, there is generally used boron or phosphorous; however, other suitable doping materials can be selected including, for example, nitrogen, or arsenic and the like. Moreover, the amorphous silicon in the trapping layer 55 or in the transport layer 53 may be alloyed with other materials, such as carbon or germanium, for the purpose of changing the band gap and therefore desirably affecting the dark discharge or photosensitive properties of the resulting xerographic device.

The selection of the type of dopant for the trapping layer, which could be p-type or n-type, depends on the corona charging polarity in which the device will be operated. Thus, if for example a positive charging polarity is chosen the xerographic image is formed by the normal transverse transport of holes across the transport layer (53). The electrons which remain under the insulator (57) have to be prevented from moving laterally in the electrostatic image fringe-fields thus under these circumstances the trapping layer is doped with p-type dopant materials such as boron, the addition of which does not affect the transverse transport of holes across the layer. Conversely, in the situation of negative charging, the trapping layer has to be n-type doped by for example the addition of phosphorous to this layer. It is believed that there is a reciprocal relationship between the dopant concentration and the thickness of the trapping layer; therefore the optimum thickness and concentration of this layer are determined experimentally by observing the effect of these parameters on image blurring and the electrical properties of the device for a fixed thickness of the insulating top layer.

For some applications it may be advantageous to have separate layers in the device for the photogeneration of charge carriers and their subsequent transport through the device in an electric field. Thus in FIG. 2 there is illustrated a photoreceptor with a separate photogeneration layer 75, and transport layer 73 equivalent to transport layer 53. In this embodiment the photogeneration layer is of a thickness of from about 0.5 to about 10 microns and preferably is of a thickness of from about 1 to 5 microns. The bandgap of this layer is usually smaller than that of the generation layer for purposes of extending the photosensitivity of the photoreceptor to longer wavelengths. Additions of germanium from germane or tin from stannane are commonly used for this purpose. The interface between the photogeneration layer, reference 75, and the charge transport layer, reference 73, can be abrupt as shown in the Figure or can be diffuse in which case compositional gradients gradually change. The thickness of the compositional transition region is of the order of from about one micron to about five microns.

The thicknesses of the top layers, with reference to FIGS. 1 and 2, for example, layers 57 and 79 which can be comprised of silicon nitride, silicon carbide or amorphous carbon, is from about 0.1 micron to about 1 microns, and preferably this layer is of a thickness of 0.5 microns. Furthermore, for the purpose of rendering the top overcoating layers more conductive, thus allowing for further desirable image enhancement, these layers can be fabricated to consist of a non-stoichiometric amount of a silicon nitride, $SiN_x$ or silicon carbide, $SiC_y$, where x is a number from about 1 to about 1.3 and y is a number between about 0.7 and about 1.3. Additionally, the overcoatings of silicon nitride, silicon carbide or amorphous carbon, can be rendered more conductive by doping these materials with from about 1 weight percent to about 5 weight percent of phosphorous, available from phosphine $PH_3$, or boron, available from diborane gas, $B_2H_6$. The silicon nitride, silicon carbide or amorphous carbon top overcoatings provide devices with additional hardness further protecting them from mechanical abrasions, including undesirable scratches.

Increased conductivity for the top layer in the photoresponsive devices of the present invention illustrated in FIG. 1, is believed to decrease the electric field over this layer more rapidly between xerographic imaging cycles, thus desirably causing the residual voltage present to be constant. Additionally, such constant residual voltage allows images of high resolution to be obtained for a very large number of imaging cycles.

The photoresponsive devices of the present invention, and the amorphous layers contained therein are prepared by simultaneously introducing into a reaction chamber, such as that illustrated in FIG. 3, a silane gas, often in combination with other gases for the purpose of doping or alloying. More specifically, this process involves providing a receptacle containing therein a first substrate electrode means, and a second counter electrode means, providing a cylindrical surface on the first electrode means, heating the cylindrical surface with heating elements contained in the first electrode means, while causing the first electrode means to axially rotate, introducing into the reaction vessel a source of silicon containing gas, often in combination with other dilluting, doping or alloying gases at a right angle with respect to the cylindrical member, applying a voltage between the first electrode means, causing a current to the second electrode means, whereby the silane gas is decomposed resulting in the deposition of amorphous silicon, or doped amorphous silicon or an amorphous silicon based insulator. The gases are introduced into the reaction chamber in appropriate relative amounts to provide the proper level of doping or alloying as indicated herein. Thus, for example, when a nominal level of 100 parts per million boron doped amorphous silicon is desired for the trapping layer, there is simultaneously introduced into the receptacle, silane gas containing about 100 parts per million of diborane gas, while when a nominal compensation level of 10,000 parts per million is desired, there is introduced into the reaction receptacle silane gas, and 1 percent of diborane gas.

Generally, the process and apparatus useful for preparing the photoresponsive devices of the present invention containing the heavily doped amorphous silicon trapping layers disclosed herein, are disclosed in copending application U.S. Ser. No. 456,935, filed on Jan. 10, 1983, the disclosure of this application being totally incorporated herein by reference. The apparatus disclosed in the copending application, as is illustrated in FIG. 3 is comprised of a rotating cylindrical first electrode means 3, secured on an electrically insulating rotating shaft, radiant heating element 2 situated within the first electrode means 3, connecting wires 6, a hollow shaft rotatable vacuum feedthrough 4, a heating source 8, a hollow drum substrate 5, containing therein the first electrode means 3, the drum substrate being secured by end flanges, which are part of the first electrode means 3, a second hollow counter electrode means 7, containing flanges thereon 9 and slits or vertical slots 10 and 11, receptacle or chamber means 15, containing as an integral part thereof receptacles 17 and 18 for flanges 9 for mounting the module in the chamber 15, a capacitive manometric vacuum sensor 23, a gage 25, a vacuum pump 27, with a throttle valve 29, mass flow controls 31, a gage and set point box 33, gas pressure vessels 34, 35, and 36, for example pressure vessel 34 containing silane gas, pressure vessel 35 containing phosphine gas, and 36 containing diborane gas, a current source means 37 for the first electrode means 3 and a second counter electrode means 7. The chamber 15 contains an entrance means 19 for the source gas material and an exhaust means 21 for the unused gas source material. In operation the chamber 15 is evacuated by vacuum pump 27 to appropriate low pressures. Subsequently, a silane gas, often in combination with other gases originating from vessels 34, 35 and 36 are simultaneously introduced into the chamber 15 through entrance means 19, the flow of the gases being controlled by the mass flow controller 31. These gases are introduced into the entrance 19 in a cross-flow direction, that is the gas flows in the direction perpendicular to the axis of the cylindrical substrate 15, contained on the first electrode means 3. Prior to the introduction of the gases, the first electrode means is caused to rotate by a motor and power is supplied to the radiant heating elements 2 by heating source 8, while voltage is applied to the first electrode means and the second counter electrode means by a power source 37. Generally, sufficient power is applied from the heating source 8 that will maintain the drum 5 at a temperature ranging from about 100° C. to about 300° C. and preferably at a temperature of about 200° C. to 250° C. The pressure in the chamber 15 is automatically regulated so as to correspond to the settings specified at gage 25 by the position of throttle valve 29. Electrical field created between the first electrode means 3 and the second counter electrode means 7 causes the silane gas to be decomposed by glow discharge whereby amorphous silicon based materials are deposited in a uniform thickness on the surface of the cylindrical means 5 contained on the first electrode means 3. There thus results on the substrate an amorphous silicon based film. Multilayer structures are formed by the sequential introduction and decomposition of appropriate gas mixtures for the appropriate amounts of time.

The flow rates of the separate gases introduced into the reaction chamber depends on a number of variables such as the desired level of doping to be be achieved. Thus, for example, the amount of boron contained in the amorphous silicon on an atomic basis is about a factor of two-to-four more than the amount of boron which is calculated from the mixing ratio of the gases diborane and silane.

Other reaction parameters and process conditions are as detailed in the copending application.

With regard to the preparation of the device structure as illustrated in FIG. 1, this device can be specifically prepared in the following manner.

The apparatus, as illustrated in FIG. 3, is evacuated by an appropriate vacuum pump and the mandrel and drum substrate are heated. The silane gas and other appropriate dopant gases or alloying gases are introduced through the mass flow controllers. Once the gas flow rate has become stationary, the pressure in the reaction chamber, that is, the pressure in the annular space between the drum substrate and the counter electrode, is regulated by means of a throttle valve in the vacuum exhaust line. When the pressure becomes stationary, voltage is applied to the mandrel containing the drum substrate and the counter electrode. This voltage is of sufficient value so as to cause breakdown of the gas in the reaction chamber, which breakdown is usually accompanied by a visible glow. The condensable species, which are created by the process in the glow discharge, deposit on the drum substrate and the counter electrode. During the process of deposition, the substrate temperature, the gas flow rates, the total gas pressure, and the applied voltages, or current, are maintained at a constant level by appropriate feedback loops. Amorphous silicon films doped with, for example, 10 parts per million diborane are fabricated by the simultaneous introduction of 100 sccm of silane gas, and 1 sccm of silane gas which is premixed, by the gas manufacturer, with 1,000 parts per million ppm of diborane gas. Subsequently, the vacuum pumps are throttled in order that the total pressure of the gas mixture in the vacuum chamber is 250 mTorr. A d.c. voltage of −1,000 volts is applied to the mandrel with the substrate electrode, and the counter electrode is maintained at ground potential. The resulting current of about 100 milli-amperes is maintained at a constant level during the deposition process. After about three hours, a film of doped amorphous silicon of a thickness of about 20 micrometers has deposited on the drum substrate. The voltage is then disconnected from the electrode and the gas flow is changed for the deposition of a thin trapping layer comprised of amorphous silicon doped with an effective amount of boron as follows.

The flow of the silane gas premixed with the diborane is increased to 50 sccm whereas the flow of the pure silane gas is decreased from 100 sccm to 50 sccm. The pressure is kept constant at 250 sccm and the high voltage over the electrodes is applied for 30 seconds, resulting in a trapping layer as illustrated in FIG. 1. The voltage is then disconnected from the electrodes and the gas flow is then changed for the deposition of the insulating hard overcoating as follows. The flow of the silane gas premixed with diborane is terminated and to the remaining flow of 50 sccm of silane gas is added 250 sccm of ammonia gas. The high voltage is now reapplied to the electrodes for 5 minutes, at the end of which time the voltage is disconnected to the electrodes and to the heater elements. The flow of silane and ammonia gases into the reactor is terminated and air is allowed into the vacuum system. Subsequently, the drum containing the amorphous silicon photoreceptor structure is removed from the vacuum chamber apparatus.

Other compositions and thicknesses for the layers can be obtained in a similar manner by adjusting the relative flow rates of the gases and the times of deposition. By changing the gases themselves, different materials can be obtained, including different overcoatings.

Photoresponsive devices with overcoatings of silicon nitride, or silicon carbide are generally prepared by the glow discharge deposition of mixtures of silane and ammonia, or silane and nitrogen; and silane with a hydrocarbon gas, such as methane, using the appartus of FIG. 3 for example, these overcoatings being deposited on the amorphous silicon trapping layer. Amorphous carbon is deposited as an overcoating in a similar manner with the exception that there is selected for introduction in the glow discharge apparatus a hydrocarbon gas, such as methane.

This invention will now be described in detail with respect to specific preferred embodiments thereof, it being understood that these examples are intended to be illustrative only. The invention is not intended to be limited to the materials, conditions or process parameters recited herein. All parts and percentages are by weight unless otherwise indicated.

EXAMPLE I

An amorphous silicon photoreceptor was fabricated with the apparatus as illustrated in FIG. 3, and in accordance with the process conditions as illustrated in copending application U.S. Ser. No. 456,935. Thus, an aluminum drum substrate, 15.8 inches long, with an outer diameter of 3.3 inches, was inserted over a mandrel contained in the vacuum chamber of FIG. 3, and heated to 225° C. in a vacuum at a pressure of less than $10^{-4}$ Torr. The drum and mandrel were then rotated at 5 revolutions per minute and, subsequently, 200 sccm of silane gas doped with 8 parts per million of diborane gas were introduced into the vacuum chamber. The pressure was then maintained at 250 milliTorr, by an adjustable throttle valve. A d.c. voltage of −1,000 volts was then applied to the aluminum drum with respect to the electrically grounded counter electrode, which electrode had an inner diameter of 4.8 inches, a gas inlet and exhaust slot of 0.5 inches wide, and was of a length of 16 inches.

When three hours had elapsed, the voltage to the mandrel was disconnected, the gas flow was terminated, and the drum sample was cooled to room temperature, followed by removal from the vacuum chamber. The thickness of the photosensitive amorphous silicon contained on the aluminum drum was determined to be 20 microns, as measured by a Permascope. This photoconductor was then incorporated into the xerographic imaging apparatus, commercially available as the Xerox Corporation 3100, and images were generated at electric fields of 20 volts per micron as measured by an electrostatic surface voltage probe which was incorporated in the drum cavity. The images, subsequent to development with toner particles comprised of a styrene-n-butyl methacrylate copolymer, and carbon black particles, and transfer of this image to paper, were of poor quality as evidenced by numerous white spots, deletions, and areas of decreased resolution, and blurring subsequent to a few imaging cycles, as determined by visual observation. The density of the print defects increased rapidly with the number of imaging cycles. The degree of loss of image resolution was determined to depend, for example, on the humidity, the age of the photoresponsive device, and the amount of abrasion during print testing.

A remarkable improvement in imaging behavior was obtained when the device as prepared above was overcoated with a trapping layer and an insulating layer. This was accomplished by depositing in the vacuum chamber, subsequent to deposition of the above amorphous silicon transport layer, a boron doped trapping layer by introducing into the vacuum chamber silane gas, doped with 500 parts per million of diborane. The deposition was continued at a temperature of 225° C. for 30 seconds, while the aluminum drum voltage was maintained at −1,000 volts. A gas mixture containing 30 sccm of silane gas, and 100 sccm of ammonia was subsequently introduced into the reaction chamber. A pressure of 250 m-Torr was maintained, and a voltage of 0.250 volts was applied to the drum substrate and the deposition process was continued for 5 minutes at which point the voltage to the drum was again disconnected. There thus results a silicon nitride layer, 0.3 microns in thickness, over the boron doped amorphous silicon layer previously deposited. The voltage to the mandrel was disconnected subsequent to removal of the resulting drum from the vacuum chamber, and it was subjected to print testing at electric fields of 20 volts per micron.

Testing of the resulting device in a Xerox Corporation copy appartus commercially available as the 3100® evidenced a residual voltage after photodischarge of 20 volts, as measured by an electrostatic probe. This residual voltage remained constant with electrical cycling for up to 20,000 cycles. Additionally, the electrical characteristics of this overcoated device, including the charge acceptance, about 500 volts, and the residual voltage, about 60 volts, caused by the silicon nitride top layer, after photodischarge, are not sensitive to humidities of from about 20 percent relative humidity to about 80 percent relative humidity, at fields exceeding 30 volts per micron. This was evidenced by the fact that the charge retention of the device measured 0.1 seconds after exposure of the top surface to a positive corona atmosphere, remains unchanged during electrical device evaluation in an environmental test chamber, where the relative humidity during testing was changed between 20 and 80 percent. During these tests, no measurable effect was observed on the residual voltage after photodischarge. Images generated in the Xerox Corporation 3100 devices were, subsequent to development with toner particles comprised of a styrene n-butyl methacrylate copolymer containing black particles, of excellent quality and did not degrade with cycling up to at least 100,000 imaging cycles at which time the test was terminated.

In contrast, a similar photoresponsive device without a trapping layer but overcoated with a silicon nitride layer, 0.3 microns in thickness, when incorporated in the Xerox Corporation 3100 device resulted in blurred images beginning with one copy cycle.

Additionally, the above-prepared photoresponsive device with a trapping layer was subjected to an abrasion test by vigorously rubbing the device for ten minutes with a pumicing compound, available from Xerox Corporation, and the resulting device was not affected in that the electrical characteristics of the device, including the charge acceptance and the residual voltage after photodischarge, were unchanged. Further, there was no noticable change in the xerographic print quality of the device prior to, or subsequent to the pumicing test.

EXAMPLE II

The procedure of Example I was repeated, wherein there was obtained the device of the present invention containing a trapping layer, with the exception that there was deposited on the substrate an amorphous silicon charge transport layer 20 microns in thickness, over a period of three hours, and at a pressure of 250 mTorr and a voltage of −1000 V applied to the central electrode. As the gas introduced into the reaction chamber in this example was pure silane there resulted a nominally undoped silicon layer. Furthermore the trapping layer was doped with phosphorous by adding phosphine gas to the silane gas in an amount of 100 parts per million molecular concentration during the plasma deposition of the trapping layer.

Subsequent to removal of the above prepared overcoated multilayer device from the vacuum chamber, the resulting photoreceptor was print tested in an imaging test fixture, wherein the photoreceptor was negatively charged, and the resulting image developed with a toner composition containing a styrene-n-butyl methacrylate copolymer resin composition, carbon black, and the charge enhancing additive cetyl pyridinum chloride. There resulted for 100,000 imaging cycles over a relative humidity range of from 20 percent to 80 percent images of excellent resolution with no blurring, as compared to blurred images with poor resolution after 10 imaging cycles wherein an identical photoreceptor device without a trapping layer was print tested in the same imaging fixture.

EXAMPLE III

A photoresponsive device was prepared by repeating the procedure of Example I, wherein there was obtained the device of the present invention with a trapping layer, with the exception that the top hard overcoating layer was fabricated by introducing in the vacuum chamber 30 sccm of silane gas, doped with 1 percent of phosphine, and 100 sccm of ammonia gas. Discharge in the vacuum chamber was then continued for 5 minutes at 250 m Torr at a current density of 0.05 milliamps/$cm^2$.

The device was tested by repeating the procedure of Example I, at fields of 30 volts per micron, and substantially similar results were achieved in that the residual voltage, as measured with an electrostatic probe, was 10 volts. This voltage remained constant after 20,000 imaging cycles and over humidity conditions ranging from 20 percent relative humidity to 80 percent relative humidity.

Print testing was then accomplished at 25 volts per micron by repeating the procedure of Example I and, subsequent to development, images of excellent resolution were obtained and no degradation of the print quality was visually observed after 25,000 cycles.

The above prepared photoresponsive device was then tested for abrasion and scratch resistance by repeating the procedure of Example I, and substantially similar results were obtained.

EXAMPLE IV

A photoresponsive device was prepared as illustrated in FIG. II, by repeating the procedure of Example I for the deposition of the first layer functioning as a carrier transport layer. Subsequent depositions were then accomplished as follows:

A photogeneration layer deposited on the above transport layer was fabricated from a mixture of 120 sccm silane, 80 sccm of germane and 2 sccm of silane premixed with 1000 ppm of diborane. This mixture was decomposed for 40 minutes at an inner electrode voltage of −1000 V and a reactor pressure of 250 mTorr. The substrate temperature was kept constant at 230° C.

A thin trapping layer was then deposited on the above photogenerating layer by the decomposition of 200 sccm of silane, premixed with 1000 ppm of diborane for 30 seconds at −1000 V interelectrode voltage, 250 mTorr reactor pressure and 230° C. substrate temperature.

An overcoating of silicon nitride was deposited on the trapping layer by the decomposition of a 5:1 mixture of ammonia to silane at a total flow rate of 500 sccm for 5 minutes, a substrate temperature of 230° C., −500 V interelectrode voltage and a reactor pressure of 250 mTorr. After removal from the vacuum system, the photoreceptor was print tested in a xerographic printer equipped with a solid state laser as light source. The laser wavelength varied, depending on power level between 7900 and 8100 Angstroms. At a linear surface speed of 15 cm. per second, xerographic prints of excellent resolution and contrast were obtained for more than 10,000 cycles, upon which the test was discontinued.

Although the invention has been described with reference to specific preferred embodiments, it is not intended to be limited thereto. Rather, those skilled in the art will recognize variations and modifications may be make therein which are within the spirit of the invention and within the scope of the following claims.

We claim:

1. An electrophotographic photoresponsive device consisting essentially of in the order stated a supporting substrate, an amorphous silicon hydrogen charge transport layer, a carrier photogenerating layer comprised of an alloy of amorphous silicon hydrogen, a trapping layer comprised of doped amorphous silicon, and a protective top insulating overcoating layer.

2. A device in accordance with claim 1, wherein the carrier transport layer is comprised of undoped amorphous silicon.

3. A device in accordance with claim 1, wherein the carrier transport layer is comprised of amorphous silicon doped with phosphorous or boron in an amount of from about 2 parts per million to about 25 parts per million.

4. A device in accordance with claim 1, wherein the amorphous silicon contained in the trapping layer is doped with boron or phosphorous in an amount of amount of from about 50 parts per million to about 10,000 parts per million.

5. A device in accordance with claim 1, wherein the overcoating layer is selected from the group consisting of silicon nitride, silicon carbide, and amorphous carbon.

6. A device in accordance with claim 1, wherein the supporting substrate is aluminum, stainless steel, electroformed nickel, or an insulating polymeric composition suitably coated with a conductive layer.

7. A device in accordance with claim 1, wherein the thickness of the charge carrier transport layer is from about 5 microns to about 50 microns, the thickness of the amorphous silicon trapping layer is from about 0.1 microns to about 5 microns, and the thickness of the top overcoating layer is from about 0.1 microns to about 1 micron.

8. A device in accordance with claim 1, wherein the top layer which is selected from the group consisting of silicon carbide and silicon nitride is rendered partially conductive by the utilization of the non-stiochiometric composition SiNx or SiCy wherein x is a number of from about 1 to about 1.3, and y is a number of from about 0.7 to about 1.3.

9. A device in accordance with claim 1, wherein the top overcoating layer of silicon nitride, silicon carbide, or amorphous carbon is rendered conductive by doping this layer with from about 0.5 percent to about 5 percent by weight of phosphorous or boron.

10. An electrophotographic photoresponsive device consisting essentially of in the order stated a supporting substrate, a layer of amorphous silicon and hydrogen with 10 to 40 percent by weight of hydrogen which functions simultaneously as a charge transporting layer and a photogenerating layer, a trapping layer of doped amorphous silicon, and a top insulating overcoating layer.

11. A device in accordance with claim 10, wherein the carrier transport layer is comprised of undoped amorphous silicon.

12. A device in accordance with claim 10, wherein the carrier transport layer is comprised of amorphous silicon doped with phosphorous or boron in an amount of from about 4 parts per million to about 25 parts per million.

13. A device in accordance with claim 10, wherein the amorphous silicon contained in the trapping layer is doped with boron or phosphorous in an amount of amount of from about 50 parts per million to about 10,000 parts per million.

14. A device in accordance with claim 10, wherein the overcoating layer is selected from the group consisting of silicon nitride, silicon carbide, and amorphous carbon.

15. A device in accordance with claim 10, wherein the supporting substrate is aluminum, stainless steel, electroformed nickel, or an insulating polymeric composition suitably coated with a conductive layer.

16. A device in accordance with claim 10, wherein the thickness of the charge carrier transport layer is from about 5 microns to about 50 microns, the thickness of the amorphous silicon trapping layer is from about 0.1 microns to about 5 microns, and the thickness of the top overcoating layer is from about 0.1 microns to about 1 micron.

17. A device in accordance with claim 10, wherein the top layer which is selected from the group consisting of silicon carbide and silicon nitride is rendered partially conductive by the utilization of the non-stiochiometric composition SiNx or SiCy wherein x is a number of from about 1 to about 1.3, and y is a number of from about 0.7 to about 1.3.

18. A device in accordance with claim 10, wherein the top overcoating layer of silicon nitride, silicon carbide, or amorphous carbon is rendered conductive by doping this layer with from about 0.5 percent to about 5 percent by weight of phosphorous or boron.

19. A method of imaging which consisting essentially of providing the photoresponsive device of claim 10, subjecting this device to imagewise exposure, developing the resulting image with toner particles, subsequently transferring the image to a suitable substrate, and optionally permanently affixing the image thereto, wherein there is obtained images of excellent quality and high resolution for over 1,000 imaging cycles.

20. A method of imaging in accordance with claim 19 wherein the charge carrier transport layer is comprised of amorphous silicon doped with from about 2 parts per million to about 25 parts per million of phosphorous or boron.

21. A method of imaging in accordance with claim 19 wherein the trapping layer is comprised of amorphous silicon doped with from about 50 parts per million to about 10,000 parts per million of phosphorous or boron.

22. A method of imaging in accordance with claim 19 wherein the top overcoating layer is selected from the group consisting of silicon nitride, silicon carbide, and amorphous carbon.

23. A method of imaging in accordance with claim 22 wherein the top coating further includes dopants.

* * * * *